United States Patent [19]

Knudsen

[11] 4,054,160

[45] Oct. 18, 1977

[54] TYING MACHINE

[75] Inventor: David S. Knudsen, St. Louis, Mo.

[73] Assignee: International Packaging Corporation, Santa Ana, Calif.

[21] Appl. No.: 748,819

[22] Filed: Dec. 9, 1976

Related U.S. Application Data

[63] Continuation of Ser. No. 597,596, July 21, 1975, abandoned.

[51] Int. Cl.[2] ..... B21F 15/04

[52] U.S. Cl. ..... 140/93 A; 53/138 A; 100/10

[58] Field of Search ..... 140/93 A, 115, 93.6, 140/149; 53/135, 138 A, 370, 198 A; 100/8, 10

[56] References Cited

U.S. PATENT DOCUMENTS

| | | | |
|---|---|---|---|
| 1,373,470 | 4/1921 | Warwick | 140/93 A |
| 1,780,815 | 11/1930 | Crutchfield et al. | 140/93 A |
| 2,524,316 | 10/1950 | Jackson | 140/149 |
| 3,354,915 | 11/1967 | Johnson et al. | 140/93 A |
| 3,490,128 | 1/1970 | Cammilli et al. | 100/10 |
| 3,919,829 | 11/1975 | Burford et al. | 53/135 |

*Primary Examiner*—Lowell A. Larson
*Attorney, Agent, or Firm*—Edward J. DaRin

[57] ABSTRACT

A tying machine for tying articles of various sizes utilizing a twist-tie ribbon. The tying machine may be quickly adjusted to control the length of the tying ribbon that is metered out by the machine and to center the article to be tied at the tying station in accordance with the size or diameter of the article to be tied.

26 Claims, 14 Drawing Figures

RDM
MDM
65
66
23
R
22
58
57
55
31
31D
31HP
56
52

TYING MACHINE

RELATED APPLICATIONS

This application is a continuation of the earlier filed application bearing Ser. No. 597,596, filed on July 21, 1975, entitled "TYING MACHINE", Now abandoned.

SUMMARY OF THE INVENTION

This invention relates to a typing machine for tying articles with a tying material capable of being twisted to form a tie and more particularly to tying machines of this type for tying articles having a wide range of sizes with a twist-tie ribbon and including provisions for quickly adjusting the machine to accommodate all the various size articles to be tied.

At the present time, there is commercially available tying machines capable of tying articles with tying materials that are twisted to form a tie. One such tying machine is commercially available from the Plas-Ties Division of International Packaging Corporation located in Santa Ana, California and is exemplified by the disclosure in U.S. Pat. No. 3,369,573 granted on Feb. 20, 1968. This semi-automatic tying machine is capable of twist-tying articles up to approximately $\frac{5}{8}$ inch in diameter. Similar machines for such tying jobs are commercially available and it presently appears that the maximum diameter of an article to be twist-tied is approximately 1 inch. These commercially available tying machines are restricted as to the size of the article to be tied by the opening, or throat, of the machine and the corresponding amount of tie material that is metered out relative to the restrictive throat. There are no known machines available that accommodate articles to be tied of varying sizes and in particular articles up to two inches in diameter. In addition to the restrictions as to the sizes of the articles to be tied, there are certain articles that are packaged in a bag or the like that could be twist-tied if a machine were available to accommodate extra long products or products having awkward shapes that cannot be accommodated either by the throat or the construction of the machines. To this end, it is presently popular to place articles in a bag, twist-tie the bag and place the resulting bagged article in a box. Similar applications are found wherein drum liners are employed and placed in the bag and tied. In addition to bag tying applications, such a machine is capable of functioning as a bundling machine for twist-tying a number of articles together. For example, rubber tubing, wood moldings and coils of wire may be twist-tied by the tying machines. For tying heavy dense items including heavily weighted articles stored in a bag that might cause the twist tie to become untied, tie strips having a plurality of reinforcing wires must be used if a twist-tie ribbon is to be employed. Accordingly, the overall configuration and width of both the entry throat for such bag tying machines as well as the overhang or clearance are important parameters to accommodate and extend the usage of the machines to present day packaging applications.

The present invention provides an improved, novel, and relatively inexpensive tying machine capable of employing the twist-tie ribbons having either a single or a plurality of reinforcing wires embedded in the ribbon casing for tying articles covering a wide range of sizes. The tying machine of the present invention is of heavy duty construction to cut and twist tying ribbons constructed of either plastic or paper and having embedded therein two reinforcing elements of 24-gauge wire. The machine is adapted for twist-tying such reinforced tying ribbons with up to $2\frac{1}{2}$ twists in order to securely hold tied articles up to 30 lbs. in weight. An advantageous feature of the tying machine of the present invention is that the machine may be quickly and simply adjusted by an operator to accommodate articles to be tied having various sizes which may range from approximately $\frac{3}{8}$ inch to 2 inches in diameter. The tying machine may be readily adjusted by a relatively unskilled operator for adjusting the amount of tying material metered out by the machine and for adjusting the centering of the articles to be tied in accordance with their size to assure that the articles are centered at the tying station and that the tying ribbon is properly formed and centered around the bag neck or the article so that it will be securely tied. The machine also has the capacity to provide at least 30 ties per minute and this rate may be increased depending upon the skill of the operator.

When the tying machine is to be used in very cold environments such as in an ice plant, the heated air generated by the drive means for the machine can be blown back into the machine to maintain it heated to render it operative for such environment without the requirement for a separate heater as is necessary in prior art tying machines. The machine may also be readily adapted to operate on its side or in an upside down position without any interference with the normal operation of the machine.

From a method standpoint, the present invention comprehends a method of tying objects of varying diameters or sizes with a twist-tie ribbon including the steps of adjusting the tying mechanism for feeding a preselected length of twist-tie ribbon from a source of supply relative to the size of the article to be tied. The preselected length of ribbon is fed to a forming scissors to form the ribbon around the article to be tied and prior to being formed around the article to be tied. It is deformed initially and then the deformed ribbon is formed around the article and carried to a tying station. By causing the scissors to be opened and closed around the article to be tied, while carrying the ribbon to the tying station, the preselected length of the twist-tie ribbon is formed around the article to be tied and positioned at the tying station and is then stripped from the scissors while twisting the ends of the ribbon upon itself to twist-tie the article.

The step of adjusting the tying mechanism may include adjusting the mechanism relative to the size of the article to be tied for centering the article at the tying station.

From a structural organization standpoint, the apparatus for tying articles comprehends means for storing a continuous length of tying material having the free end of the tying material coupled to means for metering out a preselected length of tying material from the storage means, and means for severing the preselected length of tying material from its continuous length. Movable forming means are provided for receiving the tying material from the metering means and forming the tying material around the article to be twisted thereto. The movable forming means extends adjacent the metering means for receiving the tying material from the metering means to assure positive reception of the tying material including any camber the tying material may exhibit. The apparatus includes means for receiving the tying material from the forming means and twisting the ends upon itself thereby stripping the tie material from the forming means. Means are provided for positively controlling the operation of the forming means to assure both positive clearance of the article to be tied by the tie forming means and the positive placement of the ends of the tying material at the twisting means. Drive means is coupled to each of the aforementioned means for actuating the severing means, the forming means and the twisting means to twist-tie the article.

These and other features of the present invention may be more fully appreciated when considered in the light of the following specification and drawings, in which.

Figure 8:
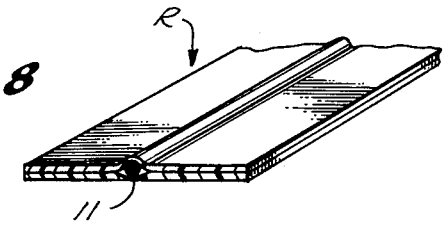
FIG. 8 is a partial, perspective view of a typical construction of a twist-tie.

Now referring to the drawings, the tying machine 10 of the present invention will be examined in detail. Specifically referring to FIG. 1, the general organization of the tying machine 10 can best be appreciated. The tying machine 10 of the present invention is a semi-automatic machine and is adapted to employ tie material or ribbon R capable of being tied by twisting it upon itself or twist-tie material R constructed of plastic or paper for covering a reinforcing wire or wires. Such tying ribbons R are presently commercially available and are employed in the present day tying machines of the prior art including the tying machine disclosed in U.S. Pat. No. 3,369,573 granted on Feb. 20, 1968. The general construction of such tying ribbons R can best be appreciated by referring to FIG. 8 which shows a tying ribbon R which may be a plastic and/or paper ribbon for embedding a reinforced wire 11 therein. The tying machine 10 of the present invention is capable of employing ribbons R having a single reinforcing wire 11, or two reinforcing wires 11, within the same unified paper and/or plastic strip. The standard, commercially available tying ribbons are five/thirty two of an inch in width and have a 24-gauge reinforcing wire. The tying machine 10 is useful to twist-tie articles with ribbons as wide as one/fourth of an inch and having two 24-gauge wires as reinforcing elements. At the other extreme, the ribbon R that may be used by the machine 10 may be one/eighth of an inch in width and have a 24-gauge reinforcing wire 11. The tying machine 10 of the present invention includes a heavy duty power train to cut and twist the aforementioned commercially available tying ribbons.

The tying machine 10 of the present invention has a capability that is not found in prior art machines in that it is capable of being quickly adjusted to tie articles of varying sizes or diameters ranging from approximately three/eighths of an inch to 2 inches in diameter. In addition, articles weighing up to 30 pounds may be tied by providing 2½ twists to the ribbon R to assure that the weight of the object will not cause the ribbon to become untwisted. In accordance with the ability to tie articles of varying sizes, the machine 10 is adjustable for feeding and metering tying ribbon R in lengths of approximately 4 inches to 9 inches and to center the selected length of the ribbon in relationship to the article to be tied. To accommodate articles having the wide range of sizes, the machine 10 is considered a "wide throat" machine in that the throat for receiving the articles to be tied is wide enough to allow the articles to be received and positioned at the machine tying station. This is to be distinguished from prior art machines and which machines are generally limited in the width of the throat and therefore cannot be used with the larger objects that the present invention can be used with. For example, the machine that is the subject of U.S. Pat. No. 3,369,573 is limited to tying articles of approximately ⅝ inch in diameter because of the restrictive opening of the throat and the metered amount of tie material. With the throat T for the tying machine 10 providing sufficient opening to accommodate all of the various articles to be tied, the amount or ribbon R that is metered in accordance with the size of the article to be tied can be readily adjusted so that the correct length of ribbon can be metered and utilized to twist-tie a wide of objects.

Figure 1:
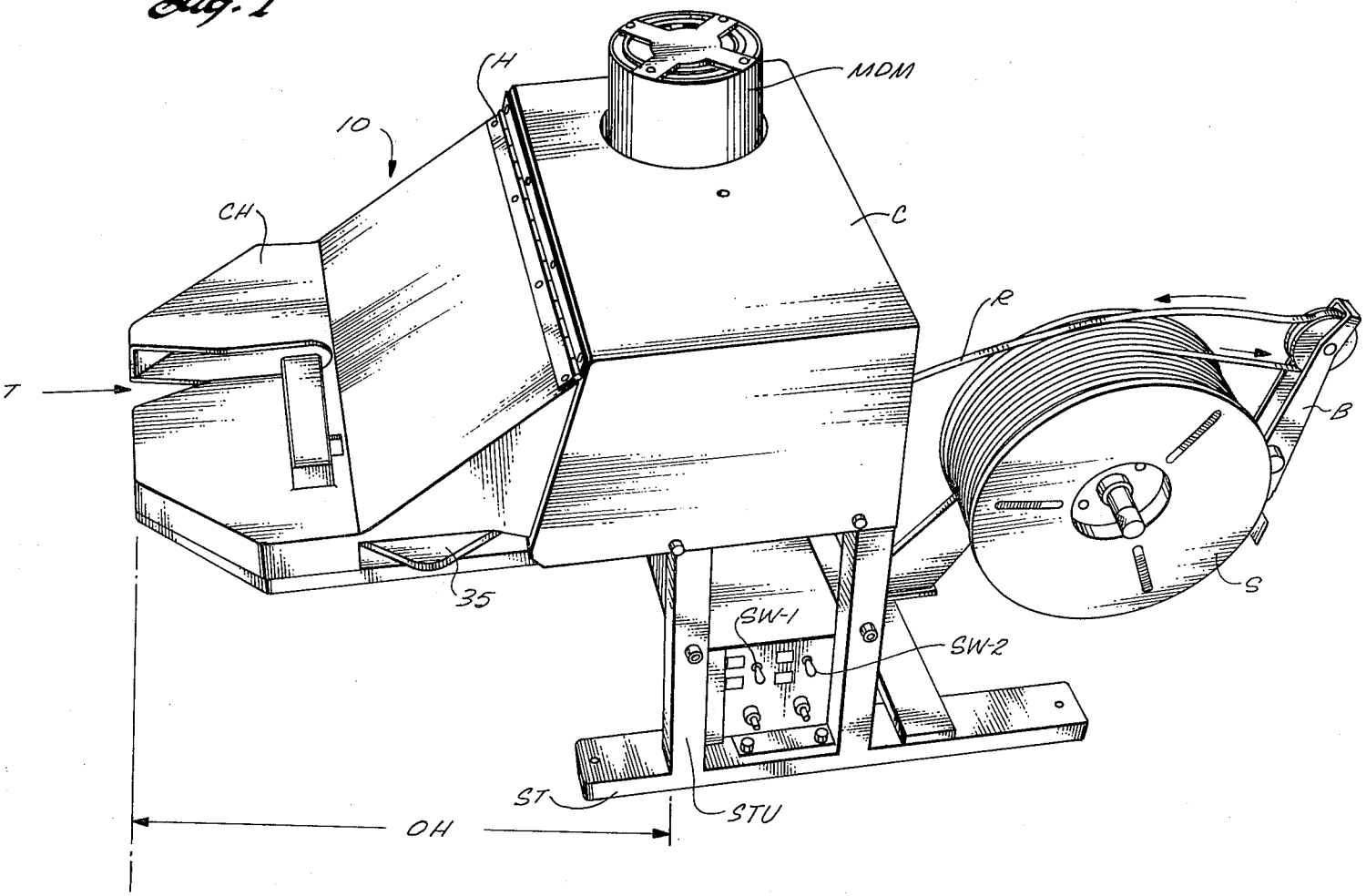
FIG. 1 is a perspective view of the tying machine embodying the present invention.
Figure 2:
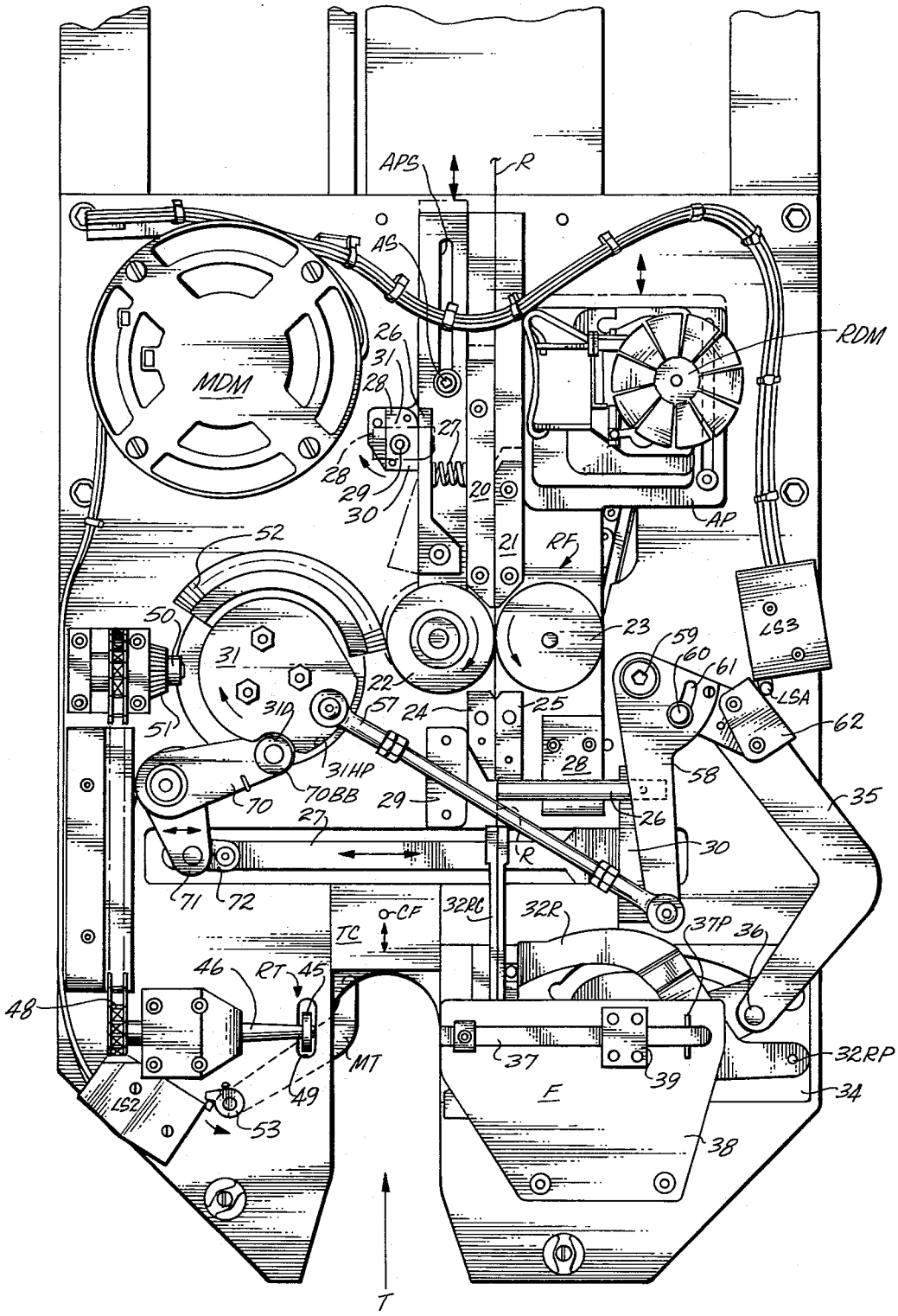
FIG. 2 is a partial, top plan view of the tying machine of FIG. 1 with the cover removed.

The ribbon R utilized in the machine 10 is stored on a spool S mounted to the rear of the machine, as best appreciated from examining FIG. 1. The spool is provided with a brake B to control and allow the rotation of the spool S only during the feeding cycles of the ribbon R into the machine proper. The machine 10 is illustrated with a cover C having a hinged portion CH at the forward end of the machine 10 and enclosing the throat T. The hinged portion CH of the cover C is hinged by a hinge H arranged adjacent the forward, top end of the cover C to allow the cover CH to be swung upwardly for exposing the throat T and the tying and forming stations of the machine as illustrated in FIG. 2. The tying machine 10 is adapted to be mounted on a bench or work station for normal tying operations to allow the operator to readily place the article to be tied into the throat T at a fairly rapid rate and easily handle the article irrespective of the diameter or the shape thereof. To this end, the machine 10 has a capacity of at least 30 ties per minute and may be extended to 35 per minute depending upon the skill of the machine operator. As illustrated in FIG. 1, the machine 10 is mounted on a stand ST secured to the machine at the lower rear of the cover C. The stand ST is of conventional construction and allows the machine to be mounted in the illustrated normal vertical relationship for tying operations. The stand ST mounts the machine 10 to also allow it to be operated on its side and/or upside down in accordance with the configuration of the article to be tied. To accommodate the various size articles to be tied with the machine 10, the stand ST is mounted to the rear of the machine to provide an overhang OH for the forward portion of the machine which allows the larger diameter articles and the like to be accommodated since they may be moved inwardly beyond the inner extremity of the throat T. To this end, the practical embodiment of the overhang OH provided for the machine 10 may be approximately 12 inches measured as indicated in FIG. 1 from the forward end of the throat to the forward end of upstanding member STU of the stand ST. The stand ST also mounts the control switches and the like for actuating the machine as will become more evident immediately hereinafter.

In order to accommodate objects of varying diameters and shapes the machine 10 is required to meter ribbon R from lengths of approximately 4 inches to approximately 9 inches and to center the length of the ribbon R in relation to the object to be tied. In accordance with the teachings of the present invention, the centering is assured by moving the entire ribbon drive assembly one-half the total tie length and then timing the ribbon feed motor to supply the other one-half of the desired length. For this purpose, the ribbon drive assembly can be moved approximately 2½ inches considering the total length of metered ribbon being between 4 and 9 inches and the total movement being one-half of the difference in tie lengths from the smallest to the largest article to be tied. The ribbon R is advanced by the provision of a separate drive motor that may be controlled through an infinitely adjustable delay relay for timing the ribbon drive motor to meter out the precise length of ribbon to make up the difference between the adjustment of position of the ribbon drive assembly and the total amount of ribbon required. For this purpose, as will be made evident hereinafter, the individual drive means for feeding the ribbon R is controlled by the delay relay to be energized for the correct and precise amount of time to coact with a brake provided for the motor so that it may be stopped quickly to correctly meter the ribbon fed into the machine proper for the tying operation. These machine adjustments will be considered hereinafter.

The machine 10 as illustrated in FIG. 2 will now be described with the machine considered as having been adjusted for tying objects within a particular range of sizes or diameters without requiring any adjustments. For example, objects falling within approximately one/-fourth of an inch in diameter of any size for which the machine has been adjusted may be tied by the machine 10 without requiring any further adjustment of the ribbon drive assembly.

Now referring to FIG. 2 the various stations comprising the tying machine 10 can be appreciated. The drive means for the machine 10 in this instance comprises two individual drive motors having different functions. The main drive motor MDM is mounted to the left rear of the machine as illustrated in FIG. 2 and powers all of the operations except the ribbon feed which is the function of the ribbon drive motor RDM arranged on the opposite side of the machine from the motor MDM or in the upper right-hand corner as illustrated in FIG. 2. The main drive motor MDM is continuously energized so that it is in operation or rotating at all times. This condition is provided for the motor MDM to provide high starting torque for the tying operation to facilitate the ribbon cutting operations by using the inertia of the motor armature and to employ an instantaneously engaging single revolution clutch to cause the machine to cycle through a single revolution for each complete tying operation. It has also been found that with the motor MDM continuously energized the heated air generated by the motor can be blown back into the machine 10 for heating the machine when it is utilized in ice plant operations and thereby eliminating the need for a separate heater. The ribbon R metered and fed out by the ribbon drive motor RDM is advanced through the ribbon feeding station RF arranged to receive the ribbon R from the spool S and advance it toward the ribbon forming station F arranged forwardly thereof and adjacent the right-hand side of the throat T, as can be best appreciated from examining FIG. 2. The ribbon forming station functions to receive the ribbon R and form it around the article to be tied positioned in the throat T and while forming the ribbon transporting it to the ribbon twisting and tying station RT arranged on the opposite side of the throat T, on the left-hand side as illustrated in FIG. 2, from the forming station F. The ribbon former F is then retracted to its normal position while the ribbon is being twisted. At this point it should be noted that there is positioned at the inner end of the throat T a motor triggering arm MT arranged in the path of the article to be tied as it is positioned in the throat by the machine operator and is movable in response to the engagement with the article to trigger and operate a switch LS-2 for energizing and cycling the main drive motor MDM.

Figure 9:
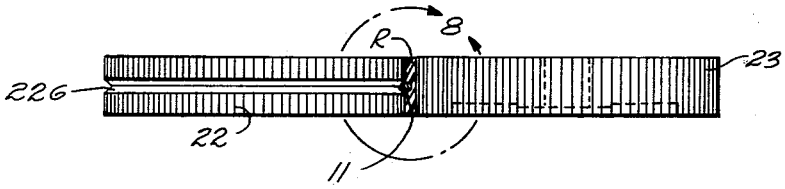
FIG. 9 is a detached, front elevational view of the twist-tie drive rollers illustrated in FIGS. 2 and 7 with a twist-tie ribbon positioned therebetween.

Now considering the ribbon feeding station RF in detail, it will be assumed that the ribbon R is withdrawn from the spool S without reference to the action of the brake B. For this purpose, the ribbon R is fed from the spool S and is immediately engaged by a pair of longitudinally extending ribbon guides 20 and 21 mounted side by side to hold and guide the ribbon between their planar surfaces. The ribbon R is guided by the outer extremity of the guide 20 into the space or channel between the guides 20 and 21 as a result of the additional length provided for the guide 20. The controlled feeding of the ribbon R between the guides 20 and 21 causes it to emerge and be delivered between the ribbon feed rollers 22 and 23 arranged immediately adjacent the exit end of the guides 20 and 21. The drive roller 23 is a serrated drive roller that is coupled to be driven by the ribbon drive motor RDM and frictionally advances the ribbon R as a result of coacting with the idler roller 22. The idler roller 22 is also a serrated roller and is provided with a groove 22G as illustrated in FIG. 9 to accommodate the protruding reinforcing wire 11 for the ribbon R. With the controlled rotation of the drive roller 23 the precise amount of ribbon R is metered from the spool S for the precise time interval of operation of the motor RDM. It will be recognized that when the ribbon R includes two reinforcing wires 11 that the idler roller 22 may be removed and a similar idler roller 22 may be mounted in its place but having two grooves 22G to accommodate the two reinforcing wires 11. The idler roller 22 may be readily removed from the machine for replacement as a result of the provision of the pivotable cam arm 28 extending upstream of the roller 22 for pivoting the arm 26 which mounts the roller 22 and allows it to be pivoted in a clockwise direction away from the drive roller 23. For this purpose, the arm 26 is resiliently spaced from the ribbon guide 20 by means of a spring 27 mounted between the arm 26 and guide 20 and secured in position by the cam 28 mounted on the opposite side of the arm 26 from the spring 27 adjacent the inner end of the arm 26 as illustrated in FIG. 2. The cam 28 is pivotally mounted by a pivot pin 29 to allow it to be rotated in a clockwise direction to allow the arm 26 and the roller 22 to swing outwardly in accordance with the movement of the cam 28. For gripping purpose the cam 28 is provided with a pair of upstanding pins 30 and 31 to allow the cam 28 to be readily rotated for positioning the arm 26 and the roller 23 at either of its two extremities. The cam 28 will assume a position arranged approximately 90° to its normal position, as indicated by the dotted outline to allow the roller 22 to be moved away from the drive roller 23.

The ribbon R as it is advanced between the drive rollers 22 and 23 is fed to a pair of ribbon guides 24 and 25 for securing the ribbon therebetween in a fashion similar to the guides 20 and 21 arranged at the ribbon entry end of the rollers 22 and 23. Arranged near the ribbon exit end of the guides 24 and 25 is a ribbon cutting knife 26 mounted for shearing the ribbon at that point from its continuous length. The knife 26 is reciprocally mounted and is controlled by the operating arm 27 which is controlled to move in the same reciprocal fashion. The knife 26 is slidably supported for its reciprocal movement by the bearing block 28 and is arranged opposite the anvil 29 upon which it abuts at its extreme left-hand position as illustrated in FIG. 2. The knife 26 is coupled to the control arm 27 by means of a connecting link 30 secured to the right-hand end of the knife 26 and also secured to the arm 27 so as to rigidly couple the knife 26 to the arm 27. The arm 27 is controlled by the cam 31 through the provision of the arms 70, 71 and 72 secured therebetween. In this fashion the knife 26 moves in unison with the control arm 27 which is controlled and actuated by the control cam 31 as will be made evident hereinafter.

Figure 3:
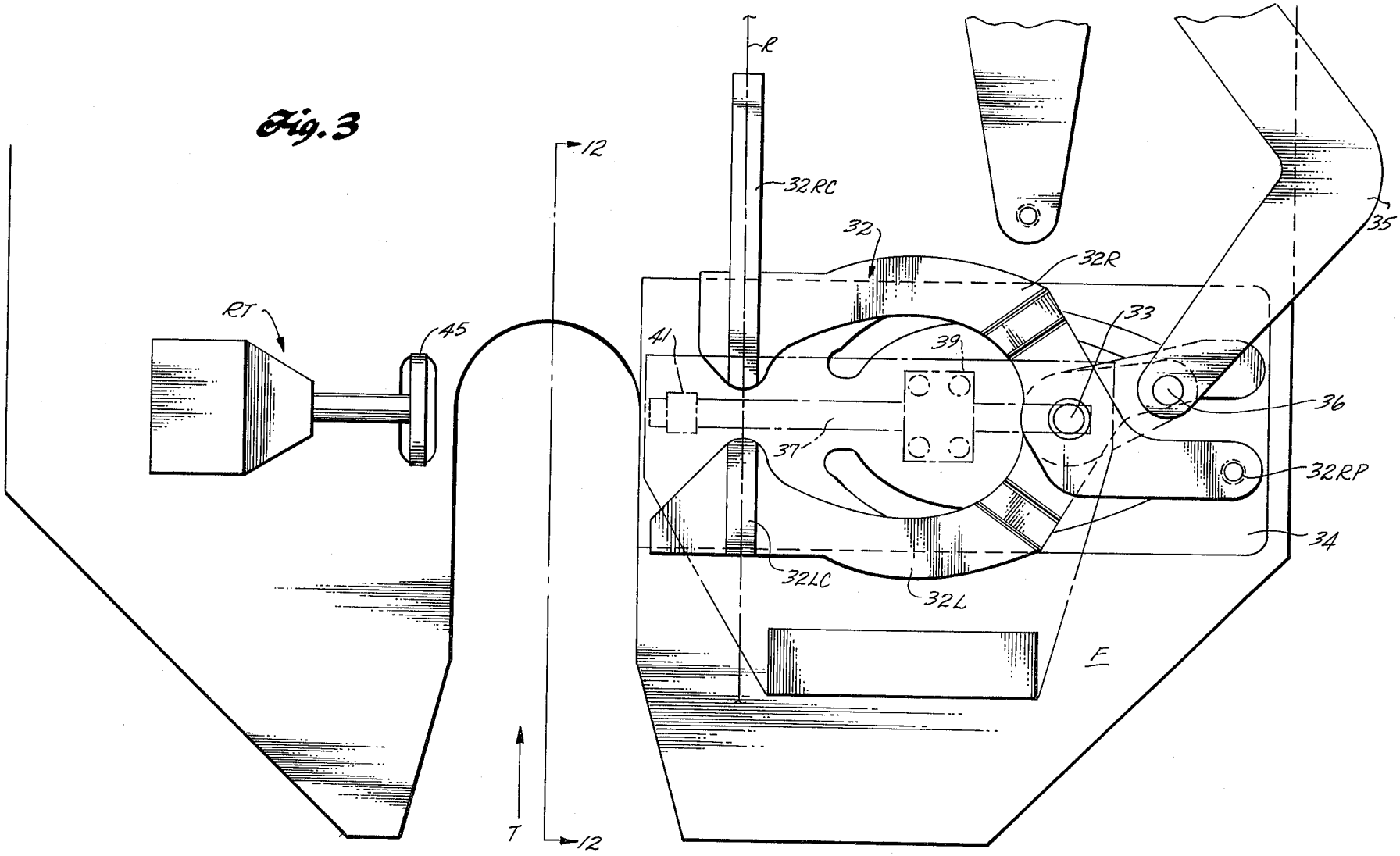
FIG. 3 is a partial, top plan view of the forming scissors shown in its inoperative fully retracted position on the machine.

As the ribbon R is fed from the drive rollers 22 and 23 through the guides 24 and 25, it is advanced to a forming station F. The forming station F as illustrated in FIGS. 2 and 3 is illustrated with a ribbon forming scissors 32 in their fully retracted or "home" position. The scissors 32 comprises a right scissor arm 32R and a left scissor arm 32L, as best seen in FIG. 3. The two scissor arms 32R and 32L are coupled together by a pin 33 that couples the two arms for movement outwardly and inwardly and linearly from its fully retracted position to the tying station RT and back to its fully retracted position, as is evident from examining FIGS. 4 and 5. The right-hand extensions for the arms 32R and 32L are positively controlled as a result of being coupled to the cam plate 34 which has a pair of cam slots 34R and 34L for controlling the movements of the respective scissor arms 32R and 32L of the scissors 32. Each of the arms 32R and 32L are coupled to the individual slots 34R and 34L by means of coupling pins secured to right-hand extremities of the arms and adapted to ride in the cam slots 34R and 34L. These coupling pins are identified as pins 32RP and 32LP for the respective arms 32R and 32L. In the same fashion, the coupling pin 33 for securing and coupling the two scissor arms also couples them to the longitudinal slot 34C of the control cam 34 which controls the linear travel of the scissors 32 to the tying station and its return to its "home" position as a result of the pin 33 sliding there along under the urging of the associated linkages controlled from the basic control cam 31. For this purpose the scissors 32 are actuated by a bell crank 35 coupled to the scissors 32 at the arm 32L by a shackle link 36 for responding to the movements imparted to the bell crank 35 at the control cam 31.

The forward ends or the left-hand ends (as illustrated in FIG. 3) of each of the scissor arms 32R and 32L are provided with ribbon receiving chutes 34RC and 32LC for loosely receiving the ribbon R as it is fed from the rollers 22 and 23 through the guides 24 and 25. The chute 32LC is mounted on and carried by the left scissor arm 32L in a fixed condition. The chute 32RC mounted on and carried by the right-hand scissor arm 32R is arranged in alignment with the chute 32LC and the guides 24 and 25. The chute 32RC is removable and is made as long as possible to maintain the unguided length of ribbon extending between the ribbon guides 24 and 25 and the chute 32RC to a minimum because of the high possibility that the ribbon R will be cambered as a result of being stored on the spool S. The length of the chute 32RC is further governed by the amount of clearance required for the chute 32RC when the scissors 32 opens up to prevent the chute from engaging and being restricted by the cutting mechanism including the chamfered end of guide 24; see FIG. 2.

The profile for the cam slots 34R and 34L has been selected to not only positively control the opening and closing action of the scissor arms 32R and 32L but also to assure proper clearance between the scissors 32 and the article to be tied positioned in the throat T and to assure the positive placement of the ends of the ribbon R in relation to the twisting station RT at the moment that the twister hook begins to revolve. This important feature assures reliable operation of the tying machine 10 especially with articles of the larger diameters that can be tied with the machine. The linear travel of the scissors 32 is controlled by the linear slot 34C for the cam plate 34 in which the pin 33 rides. The profiles selected for the cam slots 34R and 34L also assures exact positioning of the scissors 32 in the fully retracted position or in the "home" position along with the selection of the profile for the control cam 31. The linear stopping position of the scissors 32 at the "home" position is determined by a detent in the cam 31 which assures exact alignment with the chute 32RC downstream of the guides 24 and 25. The right-hand extremity of the cam slots 34R and 34L are also contoured so that as the scissors 32 is moved away from its "home" position it will move linearly to the left approximately three/eighths of an inch without any opening action to the arms 32R and 32L so that the guide chute 32RC will clear the cutting mechanism as noted hereinabove.

Figure 4:
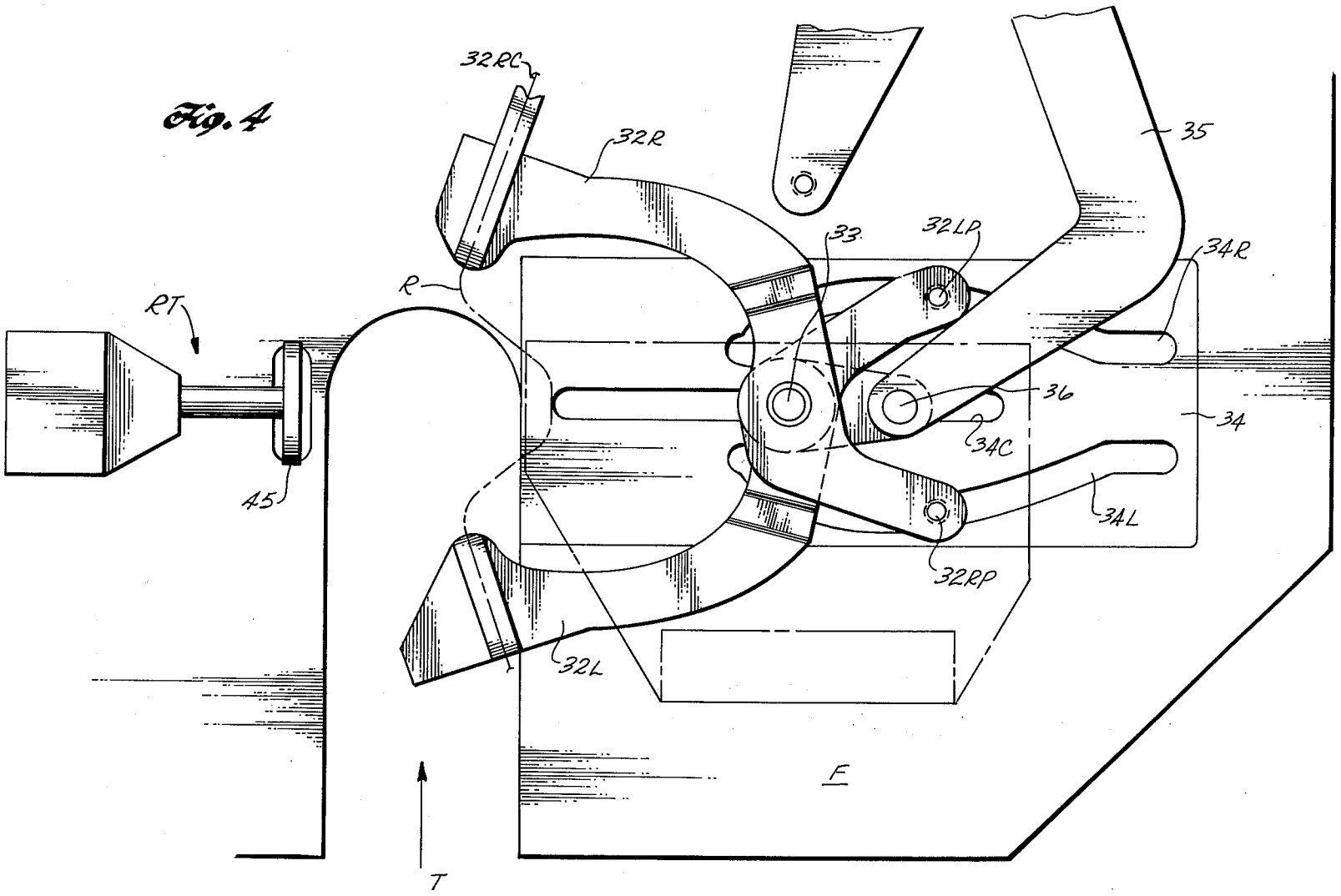
FIG. 4 is a partial, top plan view of the forming scissors moved to a position corresponding to the time that the forming retainer is lifted out of the path of the advancing tying material.
Figure 11:
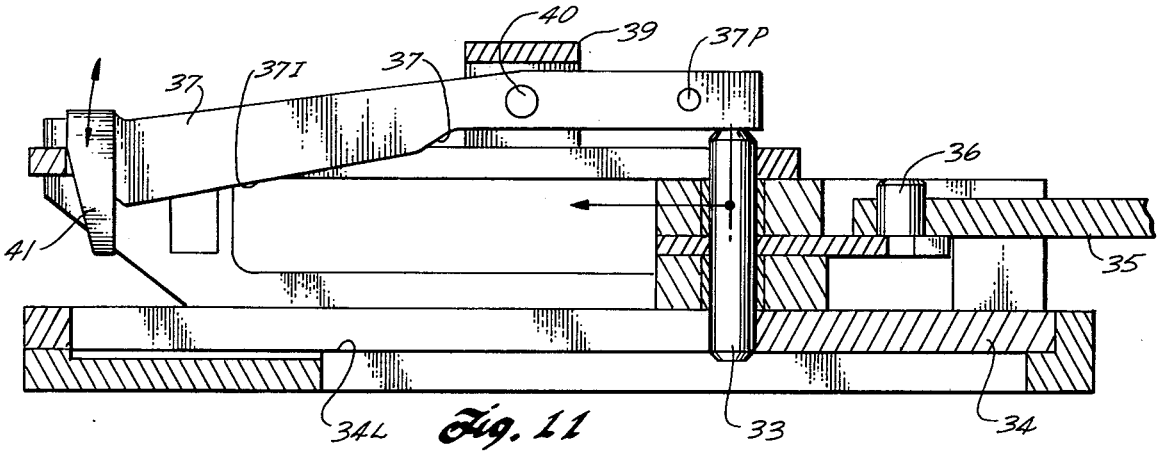
FIG. 11 is an elevational view, with portions shown in section, of the ribbon retainer mechanism coacting with the ribbon forming scissors.
Figure 12:
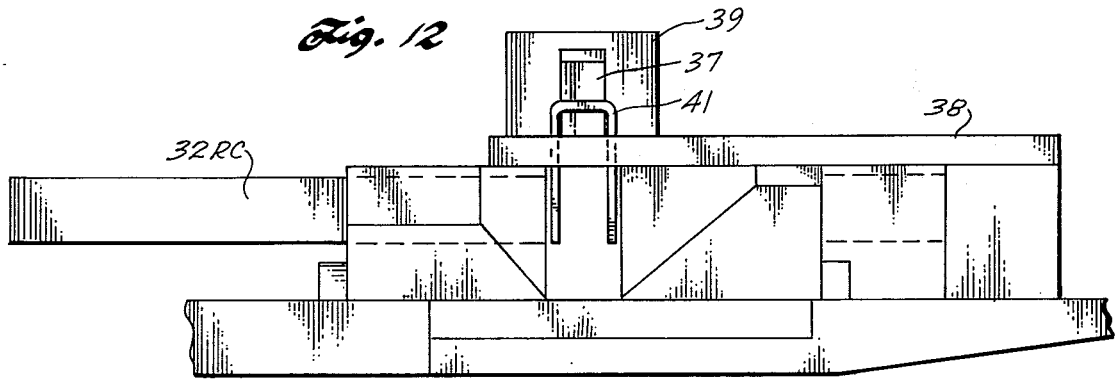
FIG. 12 is an end elevational view of the ribbon retainer mechanism illustrated in FIG. 11.

To assure that the ribbon R is pulled evenly from both of the chutes 32RC and 32LC at the twisting station RT there is further provided a ribbon retaining mechanism mounted over the scissors 32 for coaction therewith. To this end the pivot pin 33 used as a fulcrum point for the scissor arms 32RC and 32LC also functions with a retainer lifting arm 37 which is secured to the plate 38 overlying the scissors 32 and in turn is secured to the frame of the machine 10; see FIG. 2. The lifter arm 37 is secured to the plate 38 by means of a retaining plate 39 secured to the plate 38 intermediate the ends of the lifter arm 37. The lifter arm 37 is pivoted to the plate 39 by means of the pivot pin 40 so as to allow it to pivot about that point; see FIG. 11. The right-hand end of the lifter arm 37 mounts a roll pin 37P engaging the plate 38. This same end of the arm 37 engages the upper end of the fulcrum pin 33 for the scissors 32 and which pin 33 is adapted to travel along the bottom surface of the lifting arm 37. This bottom surface of arm 37 is defined as a camming surface for the pin 33 as it slides there along to control the vertical movements of the lifter arm 37 as the pin 33 slides along the slot 34C of the cam plate 34. To this end, the right-hand extremity of the lifter arm 37 is of a planar configuration and allows the arm 37 to be maintained in its normal ribbon retaining position until it engages the camming surface 37C which causes the arm 37 to swing upwardly in response thereto and to continue to progressively swing upwardly to a higher extent as the pin 33 travels beyond the surface 37C and along the inclined camming surface 37I, as can be best appreciated from examining FIG. 11. This action causes the lifting arm 37 to be moved out of the path of the ribbon R as the scissors 32 continues to move towards the tying station RT carrying the ribbon R along with it. The outer end of the lifting arm 37 carries the inverted U-shaped ribbon retaining and forming arm 41; see FIG. 12. The function of the ribbon retaining and forming arm 41 is to engage the center portion of the ribbon R extending between the chutes 32RC and 32LC and to momentarily restrain its movement and to deform or kink the ribbon R during the continuous travel of the ribbon R to the tying station RT. This deforming operation assures the even pulling of the ribbon R from the scissors 32 at the tying station RT. The retaining of the ribbon R occurs during the initial advancement of the scissors 32 towards the tying station RT during the interval before the scissor arms 32R and 32L begin to open, since it is directly in the path of the ribbon R as the scissors are moved to the left linearly. The continued movement of the scissors 32 causes the arms 32R and 32L to begin to open up when the ribbon R engages the fork 41 and will remain in the path of the ribbon until the arms 32R and 32L are fully opened. The profiles for the cam slots 34R and 34L relative to the linear movement of the scissors 32 to the left is such that when the ribbon R engages the fork 41 the scissor arms 32R and 32L begin to open up to clear the article positioned in the throat T adjacent the ribbon tying station RT. The fork 41 remains in the path of the ribbon R until the scissors 31 open to the extreme position at which time the lifting arm 37 has been engaged at its camming surfaces by the pin 33 to quickly raise the fork 41 away from the ribbon R. The exact time that this lifting action occurs in the travel of the ribbon R is illustrated in FIG. 4 and which drawing further illustrates the resulting deformation of the ribbon about its central portion. The continuous linear travel of the scissors 32 to the tying station RT will cause the arms 32R and 32L to begin to close and the ribbon to be formed about the article to be tied. The formed ribbon R is delivered adjacent the twisting element 45 at the tying station RT and allows the ribbon R to be stripped therefrom as the twister 45 is rotated for twist-tying the article centered at that position. The scissors 32 is retracted with the stripping of the ribbon R therefrom.

Figure 13:
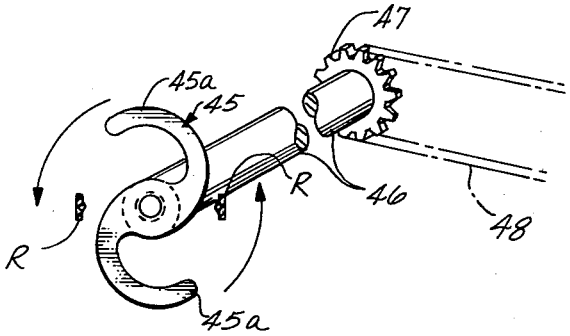
FIG. 13 is a detached, end elevational view of the inoperative twisting mechanism of the tying machine of FIG. 1 and illustrating the ends of the ribbon in a position to be twisted.

Now referring to FIGS. 2 and 13, the ribbon twisting station RT will be examined. The ribbon twisting station RT basically comprises a twist-tie twister hook 45 mounted to a rotatable shaft 46. The opposite end of the shaft 46 from the twister hook 45 mounts a sprocket 47 which is coupled to a chain 48 driven from the motor MDM for rotating the twister hook 45. The twister hook 45 is mounted over a cavity 49 formed in the machine frame to allow it to freely rotate as is evident from examining FIG. 2. The normal inoperative position of the twister hook 45 is illustrated in FIG. 13. The twister hook 45 includes the usual oppositely disposed twisting arms 45$^a$ for receiving the free ends of the ribbon R when in the inoperative position and picking up the ribbon ends with the arms 45$^a$ after the twister hook 45 is rotated. For this purpose, in the inoperative position of the twister hook 45, the openings defined by the arms 45$^a$ for the twister hook 45 are arranged to open in opposite directions and to pick up the ends of the ribbon that are presented to it by the forming scissors 32; see FIGS. 5 and 13. It should now be appreciated that with the rotation of the twister hook 45 in the counterclockwise direction the openings in the arms 45A of the hook 45 will pick up and secure the free ends of the tying ribbon R and twist the ribbon upon itself with the continuous rotation of the hook 45. The hook 45 may be readily adjusted to provide 2½ twists to the tying ribbon R or any convenient number of twists in accordance with the tying application due to the provision of a chain drive therefor.

The opposite end of the chain 48 is mounted to a stub shaft 50 secured to the frame of the machine proper. The stub shaft 50 mounts a pinion gear 51 which is driven by the segment gear 52 which is adapted to drive the pinion 51 over a preselected portion of the operating cycle and thereby rotate the twister 49. The segment gear 52 is mounted to the same shaft as the control cam 31 and is driven by the main drive motor MDM.

At the ribbon twisting station RT, there is also arranged the motor triggering switch LS-2 which actuates the drive motor MDM in response to the operation of the trigger arm MT arranged in the throat T of the tying machine 10. The trigger arm MT has its one extremity extending into the left-hand inner end of the throat T and extending underneath the machine frame to pivotally move the switch operating arm 53 into engagement with the operating arm for the switch LS-2. When the article to be tied is positioned in the throat T it will engage the trigger arm MT and cause the arm 53 to rotate counterclockwise and operate the switch LS-2 to a closed electrical condition and maintain it in this condition as long as the article maintains the trigger arm MT out of the throat proper. The release of the arm MT by the article will cause the switch LS-2 to return to its normal open circuit condition.

The drive means for the tying machine 10 comprises two electrical motors having different functions. All of the machine operations are actuated by the main drive motor MDM except one and which function is activated by the ribbon drive motor RDM. The motor RDM feeds the ribbon R from the spool S into the machine proper. The main drive motor MDM includes a single revolution clutch which may be a spring clutch. The drive motor MDM and the associated spring clutch are of conventional, commercially available construction and are utilized to provide one revolution corresponding to a single operating cycle for the tying machine 10. The main drive motor MDM is maintained energized at all times that the machine is electrically powered and the single revolution clutch is actuated in response to the operation of the trigger arm MT actuating the switch LS-2 and initiating the tying cycle. The output shaft of the main drive motor MDM is positively coupled by means of a chain 55 to a shaft 56 mounting the control cam 31 and the gear segment 52. The normal position or the deactuated position of the control cam 31 and the gear segment 52 is illustrated in FIG. 2. The control cam 31 and the gear segment 52 rotate in unison with the shaft 56 during the time intervals that the single revolution clutch is actuated.

The operations actuated by the main drive motor MDM are controlled by the control cam 31 having a preselected profile for initiating the various operations of the tying machine 10 in a particular sequence. For this purpose, the control cam 31 mounts a connecting rod 57 secured adjacent the high profile portion of the cam 31 or the portion 31HP. The connecting rod 57 has its opposite end secured to a link 58 which is pivotally secured to the frame of the machine 10 and is adapted to pivot about the pivoting member 59 secured to the frame of the machine. The link 58 is secured to the bell crank 35 for coupling and controlling the movements thereof and thereby the scissors 32. The bell crank 35 is adjustably secured to the link 58 by the provision of the fastener 60 secured in the elongated slot 61 provided for the link 58. The bell crank 35 may carry a U-shaped element 62 mounted at the inner extremity thereof adjacent the link 58 and secured thereto for operating the switches LS-3 and LS-1 arranged above one another and having operating arms LSA extending therefrom. The switch LS-1 has two operating arms, while the switch LS-3 has a single operating arm identified in FIG. 2 as the arm LSA. The movements of the link 58 and bell crank 35 in response to the movements of the connecting rod 57 are effective for movably operating the switch operating arms for the switches LS-3 and LS-2 in the correct time sequence of the machine operating cycle, as will be explained in detail hereinafter.

Figure 7:
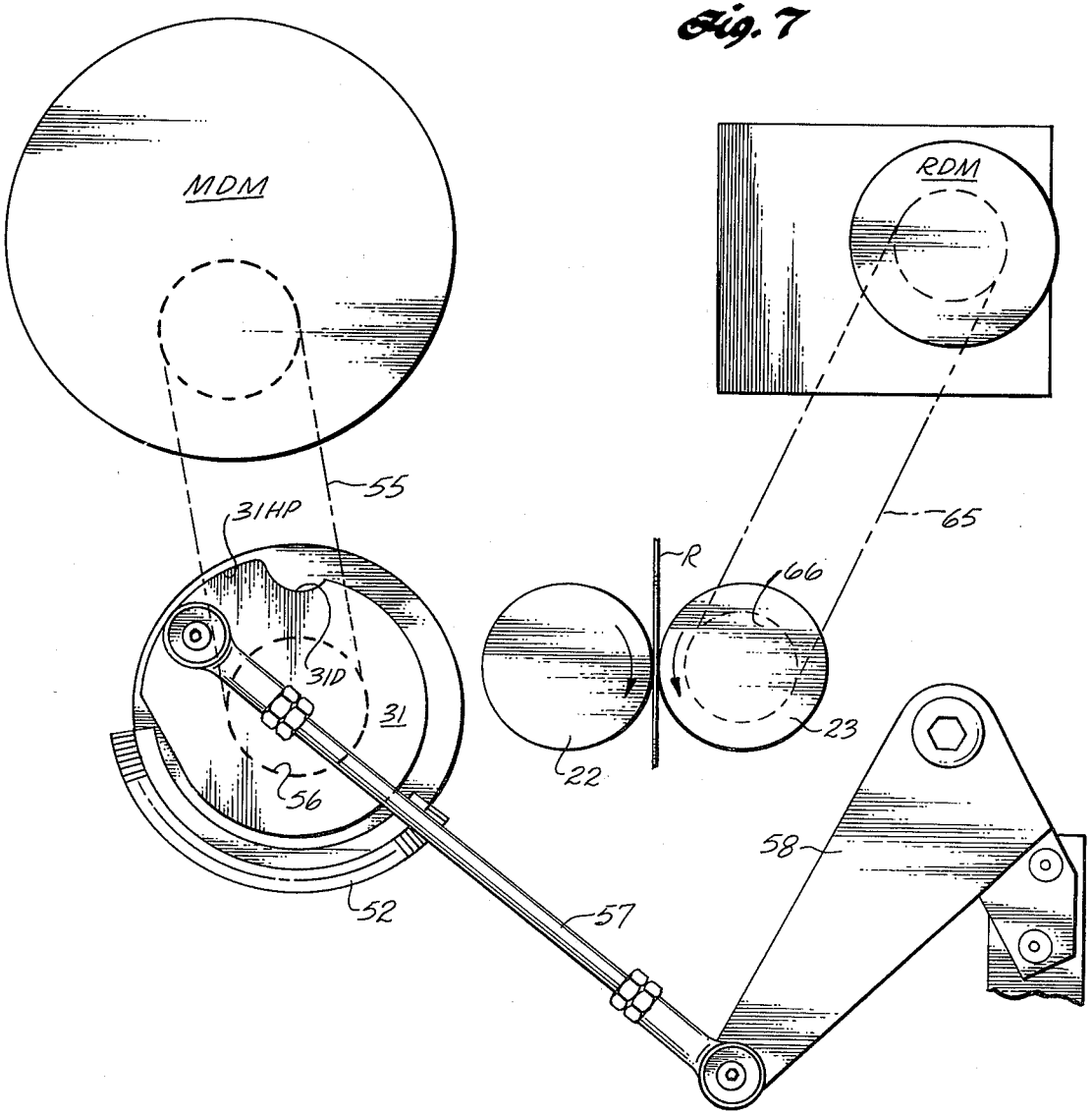
FIG. 7 is a diagrammatic representation of the drive apparatus for the machine illustrating the coupling of the driven elements to the drive motors.

By referring to FIG. 7, it will be noted that the commercially available ribbon drive motor RDM is coupled by means of a chain 65 to a drive shaft 66 mounting the ribbon drive roller 23 so that it is driven in unison with the shaft 66. The motor RDM is provided with a brake of commercially available construction so that it can quickly stop the motor shaft and thereby precisely meter the ribbon R fed from the spools. As will be made evident hereinafter, the metering of the ribbon R is also precisely controlled through the use of an electronic timer employed for timing the energization period of the ribbon drive motor RDM.

Figure 10:
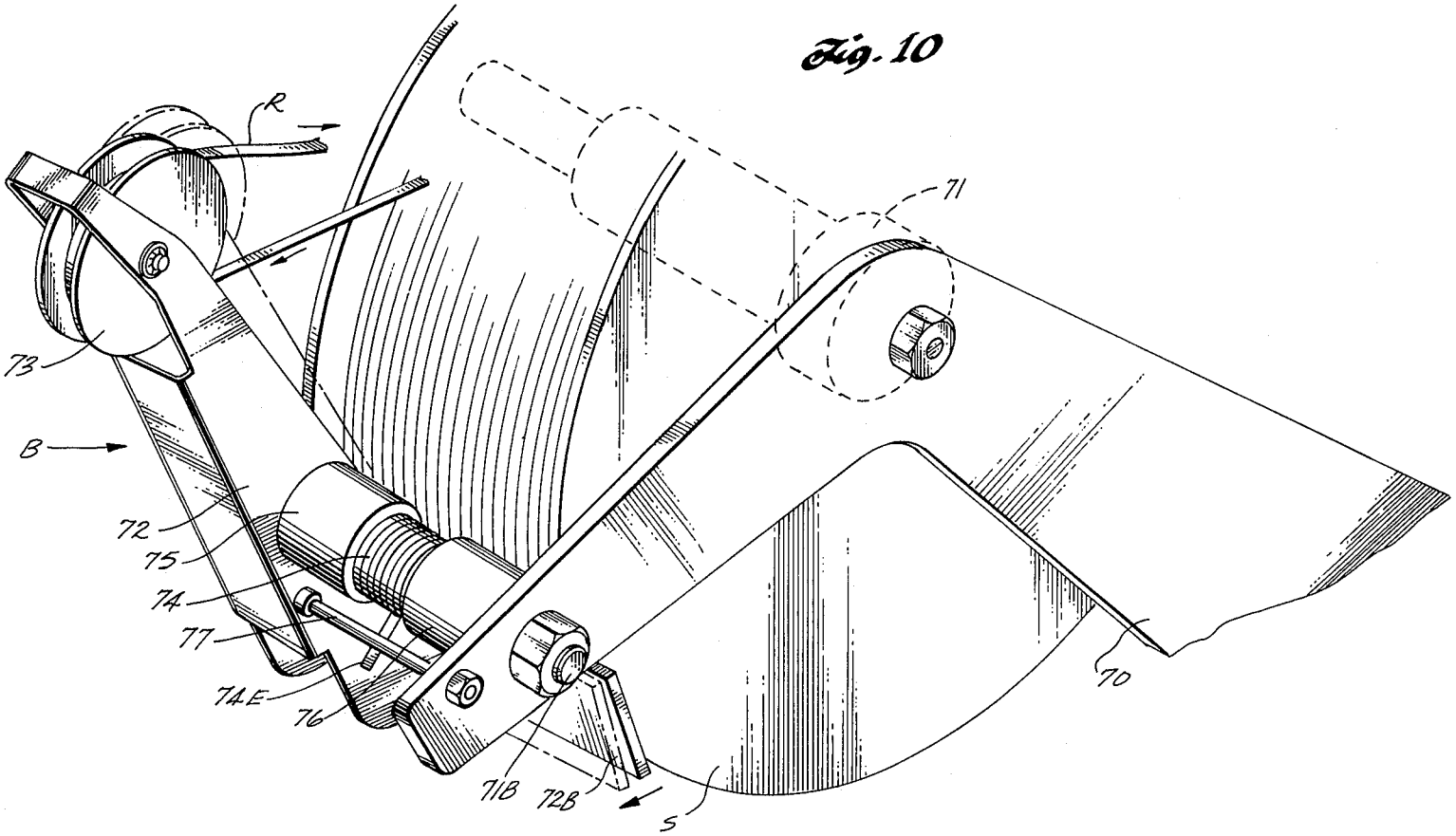
FIG. 10 is a partial perspective view of the ribbon storage spool and the braking apparatus therefor with the brake-off position illustrated in dotted outline.

Now referring to FIG. 10, the arrangement of the ribbon storage spool S and the braking apparatus B utilized therefor will be examined. It will be appreciated by those skilled in the art that some specific means for preventing the unraveling of the tying material R from the spool S during the time intervals that the tying machine 10 is not in operation and/or the time intervals that the ribbon R is not being unwound from the spool S. For this purpose, it is important to have some braking apparatus associated with the spool S to prevent the ribbon from coming unraveled during these time intervals which may render the tying machine inoperative until the tying material can once again be tensioned on the spool S for proper operation.

The braking apparatus B illustrated in FIG. 10 is of conventional construction and is mounted to the same mounting arm 70 which mounts the shaft 71 upon which the spool S is mounted. For this purpose, the arm 70 secures at its free end a mounting shaft 71B securing the upstanding bracket arm 72 which rotatably mounts an idler roller (or pulley) 73 at its free end. The idler roller 73 receives the free end of the ribbon R from the spool S and the ribbon is wound around the idler roller 73 and extends therefrom into the machine proper as is evident from examining FIG. 2. The shaft 71B secures the upstanding bracket arm 72 adjacent the free end thereof. Intermediate the upstanding bracket 72 and the end of shaft 71B, there is provided a torsion spring 74 mounted on the shaft 71B. The torson spring 74 is secured between a pair of collars 75 and 76 to tightly secure the spring 74 therebetween. One free end of the spring 74, or the end 74E is rotatably secured as the result of engagement with a shaft 77 secured to the arm 70 outwardly of the position of the shaft 71 thereon. The opposite free end of the spring 74 is similarly secured to the mounting bracket 72 (not illustrated). The mounting bracket 72 includes a longitudinally extending braking member 72B which consists of a flat plate secured to the bracket 72 to engage the flanges of the spools for preventing the rotation thereof. It will be recognized that with the demand for ribbon R in the machine 10 proper, the tension produced on the ribbon at the bracket arm 72 will cause the arm 72 and roller 73 to be moved towards the machine, or forwardly, to release the braking element 72B from the flanges of the spool S and thereby allow the ribbon R to be unwound from the spool S until the demand for ribbon is satisfied by the tension on the ribbon R being released. At this time, the bracket arm 72 will move back to its normal position with the braking plate 72B engaging the spool flanges to prevent further rotation thereof.

Figure 14:
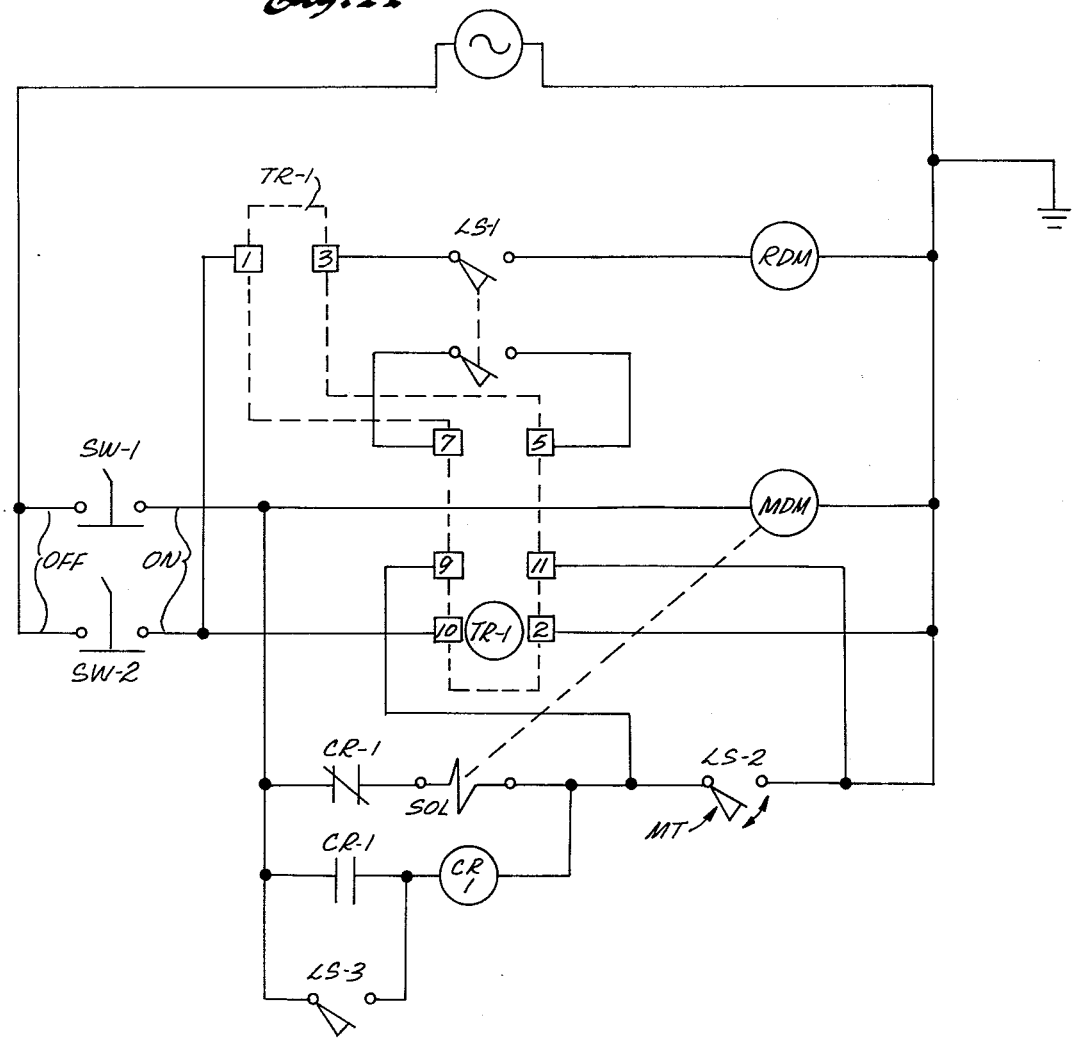
FIG. 14 is an electrical schematic representation of the control circuits for the drive motors employed in the tying machine of FIG. 1.

Now referring to FIG. 14, the electrical circuit diagram for controlling the main drive motor MDM and the ribbon drive motor RDM will be examined. The motors are connected to a source of alternating current which may be a 110-volt source. The circuit may also be converted for 220-volt and 50-cycle operation for use in foreign countries. The two drive motors are manually activated by a pair of toggle switches illustrated as switches SW-1 andSW-2. Each of these switches are shown in their normal "Off", or open circuit, position for maintaining an open electrical circuit to the two motors MDM and RDM. The switch SW-1 is connected in direct series circuit relationship with the main drive motor MDM across the alternating current source as illustrated in FIG. 14. The switch SW-2, which is illustrated in the line below SW-1, is connected through the electronic timing element identified as a TR-1 and a switch LS-1 to the ribbon drive motor RDM to the opposite side of the alternating current source, which is shown as the grounded side. Accordingly, with the operation of both switches SW-1 and SW-2 the two motors are activated. The ribbon drive motor RDM will not be energized at this time since an open circuit condition results through the switch LS-1 being maintained in its normally open circuit condition. The main drive motor RDM will be energized once the switch SW-1 is closed and will be maintained energized at all times that this switch is closed. It will be recalled that the main drive motor MDM utilizes a single revolution clutch for actuating the machine's sequential operations. The clutch is instantaneously engaged when it is pulsed by its control solenoid and which solenoid is identified in FIG. 14 as SOL and is arranged in series circuit relationship across the power source with the switch LS-2 and the normally closed relay contacts CR-1 with the "On" terminal of the switch SW-1. With the power switches actuated, then, this is the normal condition of the circuit for controlling the drive motors.

With the main drive motor MDM energized at all times, the single revolution clutch will be instantaneously engaged to commit the machine 10 to a single revolution once it is triggered. Once the triggering action occurs, the machine is caused to cycle through a complete operation in response to the operation of the switch LS-2 by an article to be tied in the throat T. At that time the solenoid SOL is momentarily pulsed with a pulse of sufficient time duration to trip the clutch and to actuate the machine 10 and cause it to follow through its sequential operations. The switch LS-2 is actuated in response to the article being placed in the throat T of the machine and engaging the trigger arm MT for causing the switch LS-2 to close. The switch LS-2 will be maintained in its closed circuit condition while the article is positioned at the inner extremity of the throat T. The clutch once pulsed by the solenoid SOL will cause the machine 10 to be committed to one full revolution. As the machine 10 goes through its various cycles of operation controlled by the cam 31, at the appropriate time, the bell crank 35 will be moved to cause the actuating element 62 to trip the operating arms LSA for the switches LS-1 and LS-3. This will cause the normally closed contact CR-1 for the relay CR1 to open and de-energize the solenoid SOL and to correspondingly close the normally open contact CR-1 that is arranged in series circuit relationship with the relay CR1. With the closing of the contact CR-1, the relay CR will be maintained in a closed circuit condition when the switch LS-2 is closed.

At this same time, the pair of contacts for the switch LS-1 will have been closed by the element 62 so that the timer TR-1 will be energized and close the contacts 1 and 3 for the timer TR-1 to thereby energize the ribbon drive motor RDM. The closing of the switch LS-3 (with LS-1) will assure energization of the relay CR1 and keep the solenoid SOL out of the circuit until a single machine cycle is completed. Similarly, the relay CR1 will be powered by the closing of contacts 9 and 10 for the relay TR-1 arranged around the switch LS-2 for this purpose. This is a safety feature which has been introduced into the circuit by providing the contacts 9 and 11 to provide a circuit path around the switch LS-2 for maintaining the relay CR1 in operation. After the relay TR-1 times out for the preselected time interval, correlated to the amount of ribbon to be metered, the ribbon drive motor RDM will become de-energized. To assure that the motor RDM is quickly stopped so that the amount of ribbon R that is metered is carefully controlled, a motor brake is included with the motor RDM to cause it to stop revolving very quickly. The time of energization of the motor RDM is adjustable by adjusting the timer TR-1.

Referring now to FIG. 2 in particular, the adjustable features of the tying machine 10 will be examined. The machine 10 may be adjusted very quickly to control the amount of ribbon R that is metered therefrom in relation to the sizes or diameters of the articles to be tied. In addition, the tying machine 10 is provided with adjustable means for an article to be centered at the twister 45 to assure that the ribbon R is centered about a bag neck, for example, and the ribbon ends will be properly received by the twister hook 45. The metering of the ribbon R is controlled by two different means. The total length of the ribbon R for properly tying a particular diameter bag, for example, is generally known. One-half of the tie length can be metered by adjusting the position of the entire ribbon drive assembly with the other one-half being provided by the adjustment of the timer TR-1 for timing the interval of time that the motor RDM is energized and thereby advance the ribbon R. The ribbon drive assembly for this purpose is mounted on a movable plate AP which mounts the ribbon drive motor RDM, ribbon guides 20 and 21, ribbon drive rollers 22 and 23, guides 24 and 25, and the knife 26 so that the entire ribbon feed drive may be moved towards and away from the ribbon forming station F in accordance with the amount of ribbon required to be metered for the particular diameter of the article to be tied. The one-half length of ribbon R to be metered by the adjustment of the plate AP is measured from the face of the ribbon exit end of the guides 24 and 25 to the longitudinal center line of the twister hook 45 or the shaft 46. For this purpose, the machine may be calibrated along the side the plate AP in relation to the varying diameters of the articles to be tied. The machine operator may then quickly adjust the position of the plate AP. The adjustment of the plate AP is provided for by means of the adjusting slot APS illustrated in the upper left-hand corner of the plate AP in FIG. 2, which longitudinally extends on the plate. The selected position of the plate AP is fixed by securing the adjusting screw AS to the frame of the machine through the slot APS. The operator need only loosen the adjustable screw AS, move the plate AP in the correct direction in accordance with the desired amount of ribbon R to be metered and then secure the screw AS to maintain the plate APS in the selected position.

Similarly, the timer TR-1 can be readily adjusted by a movable arm or the like that may be calibrated for the same range of bag neck diameters as the scale for the plate AP and will control the remaining length of the ribbon R to be metered by the drive motor RDM.

The article to be tied must also be centered in the throat T with respect to the center of the twister 45 to cause the length of ribbon R to be centered about the bag neck. For this purpose a centering plate TC is movably secured to the inner end of the throat T to arrest and position the article to be tied at the tying station. The centering plate TC is movable towards and away from the center line of the twisting shaft 46 and the linear slot 34C for the cam plate 34. The plate TC is moved to position it at a distance of one-half of the diameter of a bag neck, for example, from the center line of the twister 45. The position of the plate TC is secured by a removable fastener CF which secures the plate in a selected position and may be loosened to allow the position of the plate to be moved in the desired direction for centering purposes.

With the above structure in mind, the complete operation of the tying machine 10 can now be described. It will be assumed that the machine 10 has been adjusted for tying an article of a particular diameter and no adjustments are required for metering the correct length of ribbon R or the centering of the article at the tying station.

The tying operation is initiated by closing the switches SW-1 and SW-2 to activate the motors RDM and MDM. This will energize the main drive motor MDM and maintain it energized as a result of the closing of the switch SW-1. The article to be tied may then be placed into the throat T of the machine 10 and in doing so will engage the motor trigger arm MT which will be moved out of the path of the article to be tied and thereby actuating the switch operator 53 for closing the switch LS-2. The closing of the bag switch LS-2 will momentarily pulse the solenoid SOL to actuate the single revolution clutch associated with the drive motor MDM. With this action the tying machine 10 will be committed to complete a single revolution for sequencing through its operations. It will be assumed that the ribbon R has been previously fed into the machine and brought through the ribbon exit end of the guides and through the chutes 32RC and 32LC. With the tripping of the switch LS-2, the control cam 31 will begin to rotate clockwise in response to the actuation of the single revolution clutch.

During the first 15 degrees of rotation of the control cam 31, the ball bearing 70BB which is mounted to the free end of the bellcrank 70 at the detent 31D of the control cam 31 will be forced out of the detent 31D. When the ball bearing 70BB is forced out of the detent 31D it will travel along the high portion 31HP of the cam 31 and actuate the knife 26. The knife 26 is actuated through the movement transmitted through the series of secured arms provided by the bell crank 70, arms 27, 30, 71 and 72 which force the knife 26 to move to the left as illustrated in FIG. 2. In moving to the left, the knife 26 will shear the ribbon R from the remaining portion of the ribbon extending upstream to the spool S. At this time, it will be recognized that the ribbon R will extend into the chutes 32RC and 32LC of the forming scissors 32. As the control cam 31 continues to rotate, the connecting rod 57 (which had been on bottom dead center) begins to pull bell crank 35 which is connected to the scissors 32 by the shackle link 36. The bell crank 35 may cause the stroke of the connecting rod 57 to be slightly multiplied. In response to the movement of the bell crank 35, the scissors 32 will then advance in a straight line towards the article to be tied in the throat T. The motions of the scissors 32 are controlled by the cam plate 34 during the advancement of the scissors 32 towards the article to be tied. During the initial movement of the scissors 32, the ribbon R will engage the fork 41 to be retained and thereby deformed. At the time when the ribbon R contacts the fork 41, the arms of the scissors 32 will begin to open to clear the article to be tied that is held at the throat T of the machine 10. The fork 41 will remain in the path of the ribbon R until the scissors have fully opened to their extreme position as illustrated in FIG. 4. At this time the lifter arm 37 will quickly raise the fork 41 away from the ribbon R. The scissors 32 will continue to be advanced towards the tying station RT and the ribbon R will be formed around the article to be tied during this interval.

Figure 5:
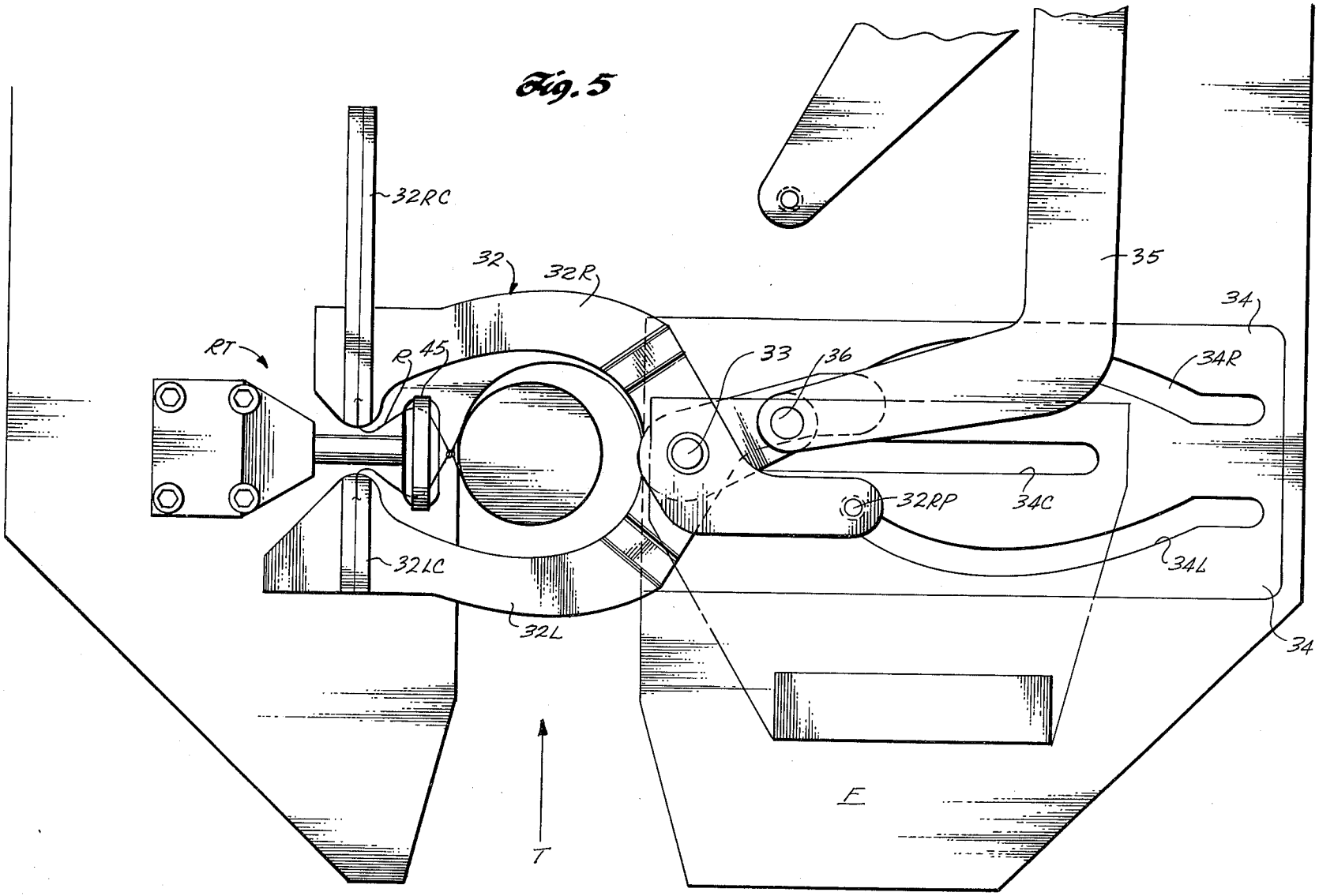
FIG. 5 is a partial, top plan view of the forming scissors moved to a fully extended position at the tying station and illustrating a twist-tie article positioned at the tying station.
Figure 6:
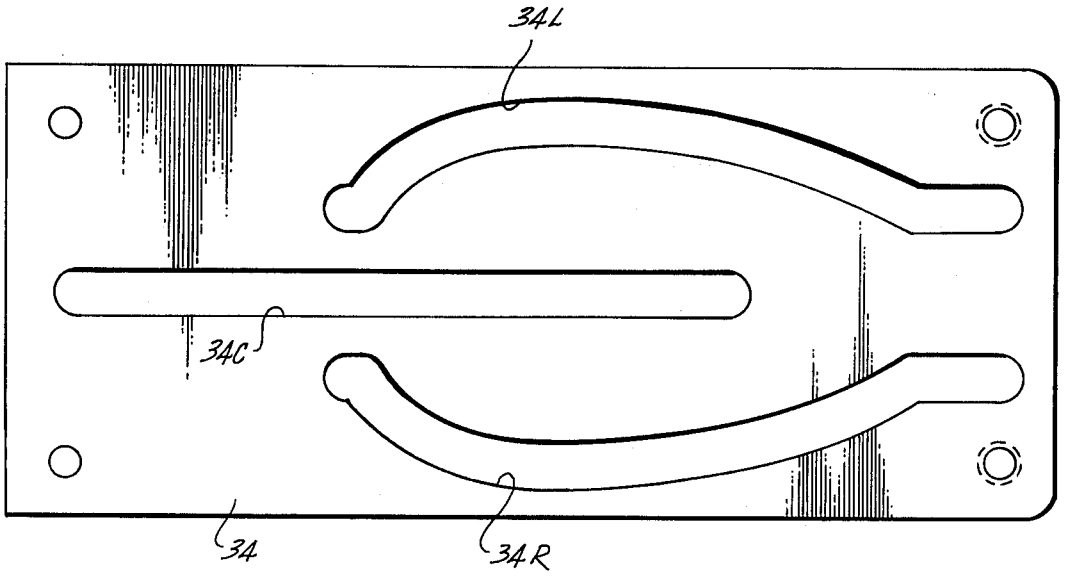
FIG. 6 is a detached, top plan view of the camming control plate for controlling the movement and operation of the forming scissors as illustrated in FIGS. 3–5.

As a result of the ribbon R being deformed in the manner illustrated in FIG. 4, a tightening effect occurs as the scissors 32 close around the article to be tied. This tightening effect is most pronounced on bags or packages having the larger diameter necks. The scissors 32 continue in this fashion and completely close around the article to be tied at the top dead center position of the cam 31 and which position is illustrated in FIG. 5. At this time in the cycle of operation, the ribbon R is in a position to be picked up by the twister hook 45. At this time the twister hook 45 is actuated by the gear segment 52 engaging the pinion 51 and rotating the twister shaft 46 in response thereto. As the twister hook 45 begins to rotate counterclockwise, it will pick up the free ends of the ribbon R and strip them from the scissors 32 and being the twisting tying operation. At this time, the scissors 32 will begin to retract from the tying station RT and move linearly in the opposite direction from left to right to its "home" position.

In moving from the tying station RT to "home", the scissors 32 move through the reverse sequence described for the opening and closing of the scissor arms 32R and 32L. As the scissors 32 approach the "home" position, the cam 31 is at the bottom dead center and the pin 33 for the scissors 32 will engage the lifter arm 37 to force it back into its normal down position. The bell crank 70 will then drop into the detent 31D for cam 31 just as the single revolution clutch on the main drive motor MDM disengages to terminate the cycle. The detent 31D for the cam 31 assures that the scissors 32 are exactly positioned at the "home" position every time. The "home" position is defined slightly inwardly from the terminal end of the control cam slots 34R, 34L and 34C to assure that the scissors are not forced up against the end walls. At this same point in time, the bell crank 35 will activate the operating arms LSA for the switches LS-3 and LS-1 to place the ribbon drive motor RDM across the source of power and cause the ribbon drive roller 23 to rotate. With the actuation of the drive roller 23, the ribbon R will be advanced as a result of the coaction of the drive roller 23 with the roller 22. The ribbon will be advanced for the interval controlled by the relay TR-1 to provide the correct metering of the ribbon for the successive tying operation. The ribbon motor RDM will be stopped when the time delay relay TR-1 times out causing the brake associated with the motor RDM to quickly stop the motor and the feeding of the ribbon R. The article can then be removed from the throat T and the machine is ready for the next tying operation.

If the next article to be tied exceeds the diameter of the previous article to require adjustment of the machine 10 for metering the ribbon R and the centering of the article, these operations must be performed by the operator before the article can be tied. Once these adjustments are completed, the next article to be tied may be placed into the machine 10 at the throat T and the above sequence of operations is repeated.

What is claimed is:

1. Apparatus for tying articles of varying diameter with a twist-tie ribbon comprising:

means for twist-tying articles having an adjustable opening to receive articles to be tied within the opening, and means for adjusting the first mentioned means to control the length of the twist-tie ribbon metered out for tying objects of various sizes and adjustable means for adjusting the opening of the machine for centering objects of various sizes to be tied in said first mentioned means.

2. Apparatus for tying articles with tie material capable of being twisted to form a tie comprising:

means for storing a continuous length of tie material;

means for metering out a preselected length of tie material from the storage means;

means for severing the preselected length of tie material from the continuous length of tie material;

means for receiving the preselected length of tie material and forming it around an article to be tied after it is severed;

means for receiving and twisting tie material presented to it by receiving and twisting the ends of the tie material on itself, said twisting means being arranged in a spaced relationship relative to said forming means;

said receiving and forming means being movable towards the twisting means and including means for positively guiding and forming the tie material around an article to be tied and presenting the tie material ends to said twisting means; and drive means coupled to each of the aforementioned means for actuating the severing means, the forming means and the twisting means to twist-tie an article positioned in the machine.

3. Apparatus for tying articles with tie material capable of being twisted to form a tie as defined in claim 2 wherein said means for metering out a preselected length of tie material includes an individual drive means for actuating the metering means and timing means for controlling the length of time the drive means is actuated.

4. Apparatus for tying articles with tie material capable of being twisted to form a tie as defined in claim 2 including means for rapidly adjusting the tying apparatus for tying articles of varying sizes over a relatively wide range of sizes.

5. Apparatus for tying articles with tie material capable of being twisted to form a tie as defined in claim 4 wherein the adjusting means includes adjustable means for centering an article to be tied at the twisting means.

6. Apparatus for tying articles with tie material capable of being twisted to form a tie as defined in claim 5 including actuating means movably mounted in the path of the article to be tied as the article is positioned at the twisting means for actuating the drive means.

7. Apparatus for tying articles with tie material capable of being twisted to form a tie as defined in claim 6 wherein said tie material storage means comprises a rotatable spool having the tie material wound thereon and extending into the metering means and including means for preventing rotation of the spool except during the intervals the tie material is metered therefrom.

8. Apparatus for tying articles with tie material capable of being twisted to form a tie as defined in claim 2 wherein said forming means includes means for assuring that the tie material is pulled evenly from the forming means when received and twisted by the twisting means.

9. Apparatus for tying articles with tie material capable of being twisted to form a tie comprising:

means for storing a continuous length of tie material having its free end extending outwardly therefrom;

means receiving the free end of the tie material for metering out a preselected length of tie material from the storage means;

means for severing the preselected length of tie material from the continuous length of tie material;

movable means for receiving the tie material from the metering means and forming the tie material around an article to be tied, said movable means including means extending adjacent the metering means for receiving the tie material from the metering means to assure positive reception of the tie material including any camber the tie material may exhibit;

means for receiving the tie material from the forming means and twisting the ends of the tie material on itself and thereby removing the material from the forming means;

means for positively controlling the operation of the forming means to assure positive clearance of the various sized articles to be tied when positioned to be tied and positive placement of the ends of the tie material at the twisting means; and drive means coupled to each of the aforementioned means for actuating and operating the severing means, the forming means and the twisting means to twist-tie an article positioned to be tied.

10. Apparatus for tying articles with tie material capable of being twisted to form a tie as defined in claim 9 wherein said means for metering out a preselected length of tie material includes an individual drive means for actuating the metering means and timing means for controlling the length of time the drive means is actuated, the individual driving means being electrical motors and the timing means being electronic timing means.

11. Apparatus for tying articles with tie material capable of being twisted to form a tie as defined in claim 9 including means for rapidly adjusting the tying apparatus for tying articles of varying sizes over a relatively wide range of sizes.

12. Apparatus for tying articles with tie material capable of being twisted to form a tie as defined in claim 11 wherein the adjusting means includes adjustable means for centering an article to be tied at the twisting means.

13. Apparatus for tying articles with tie material capable of being twisted to form a tie as defined in claim 12 wherein said tie material storage means comprises a rotatable spool having the tie material wound thereon and extending into the metering means; and including means for preventing rotation of the spool except during the intervals that tie material is metered therefrom.

14. Apparatus for tying articles with tie material capable of being twisted to form a tie as defined in claim 9 wherein the apparatus includes frame means for the apparatus constructed and defined with an article receiving throat for receiving articles of varying sizes, over a relatively wide range of sizes, to be tied, and including adjustable stop means for centering the article to be tied in the apparatus.

15. Apparatus for tying articles with tie material capable of being twisted to form a tie as defined in claim 14 including actuating means movably mounted in the throat in the path of an article to be tied for actuating the drive means.

16. Apparatus for tying articles with tie material capable of being twisted to form a tie as defined in claim 9 including means for movably mounting the metering means and the severing means for adjusting the length of tie material that is metered out to accommodate articles of varying sizes.

17. Apparatus for tying articles with a twist-tie ribbon comprising:

means for advancing a preselected length of ribbon from a continuous length of twist-tie ribbon;

means for severing the preselected length of ribbon from its continuous length;

means for twisting the ends of a twist-tie ribbon delivered thereto;

movable means for receiving the ribbon from the advancing means and for forming the severed ribbon around an article to be tied while delivering the thus formed ribbon to the twisting means;

said forming means including means for assuring that the ribbon is evenly pulled from the forming means at the twisting means; and drive means coupled to operate said advancing means, severing means, twisting means and forming means.

18. Apparatus for tying articles with a twist-tie ribbon as defined in claim 17 including means for limiting the length of unexposed ribbon during the ribbon advancing operations including while the ribbon is being advanced from said advancing means to said forming means.

19. Apparatus for tying articles with tie material capable of being twisted to form a tie as defined in claim 9 wherein the forming means comprises fork means mounted for movement towards and away from the twisting means while opening and closing around the various sized articles to be tied when positioned to be tied.

20. A method for tying objects of varying diameter with a twist-tie ribbon including the steps of:

adjusting the tying mechanism for feeding a preselected length of twist-tie ribbon from a supply of ribbon relative to the size of an article to be tied;

feeding a preselected length of twist-tie ribbon to forming scissors for forming the ribbon around an article to be tied;

de-forming the ribbon, and forming the de-formed ribbon around the article to be tied while the ribbon is carried to a tying station by the scissors to assure that the ribbon will be evenly pulled at the twist tying station;

causing the scissors to successively open around the articles to be tied to assure clearance thereof and close around the article to be tied while carrying the ribbon to the tying station; and stripping the ribbon from the scissors while twisting the ends of the ribbon upon itself to twist-tie the article.

21. A method for tying objects of varying diameter with a twist-tie ribbon as defined in claim 20 wherein the steps of adjusting the mechanism includes adjusting the mechanism relative to the diameter of an article to be tied for centering the article at the tying station.

22. A method for tying objects of varying diameter with a twist-tie ribbon including the steps of:

adjusting a twist-tie mechanism for metering out a preselected length of tying ribbon correlated to the size of the object to be tied with the ribbon;

positioning the object to be tied in the adjusted twist-tie mechanism;

actuating the twist-tie mechanism while positioning it to be tied;

automatically twist-tying the positioned article with the tying mechanism in accordance with the following sequential order of steps:

severing the previously metered length of tying ribbon from a continuous length of ribbon;

forming the ribbon around the article positioned to be tied while delivering the formed ribbon to a tying station for the mechanism, the forming step including forming the ribbon for assuring the ribbon is evenly pulled from the forming means at the tying station;

twisting the ends of the ribbon delivered at the tying station while stripping the ribbon from the ribbon former and deliverer;

retracting the ribbon former to its "home" position while the ribbon is being twisted;

metering out a preselected length of tying ribbon for the successive tying operation;

withdrawing the twist-tied article from the tying mechanism; and de-actuating the tying mechanism.

23. A method for tying objects with a twist-tie ribbon including the steps of:

feeding a preselected length of ribbon from a supply of ribbon;

severing the preselected length of ribbon from its continuous length;

transporting the severed length of ribbon to a twist-tying station;

de-forming the severed length and forming the de-formed length of ribbon around an article to be tied while transporting the ribbon to the tying station; and twisting the ribbon formed around the article to be tied to twist-tie the ribbon to the article thereby twist-tying it.

24. A method for tying objects with a twist-tie ribbon as defined in claim 23 including limiting the amount of unexposed ribbon during the ribbon feeding steps to correct any camber the tie material may exhibit during said steps.

25. A method for tying objects of varying diameter with a twist-tie ribbon including the steps of:

providing a twist-tie ribbon tying machine having an adjustable opening to receive an article to be tied and means for adjusting the length of ribbon metered out for tying objects of variable diameters and for centering the article to be tied relative to the tying station in accordance with the size of the article to be tied;

adjusting the machine for metering out a preselected length of ribbon;

adjusting the opening of the machine to center an article to be tied positioned in the opening in accordance with the diameter of the article relative to the tying station;

positioning and centering an article to be tied at the machine tying station;

metering out a preselected length of ribbon;

cutting off the preselected length of ribbon;

advancing the length of ribbon to the tying station; and while advancing the ribbon forming the ribbon around the article to be tied, including momentarily restraining the central portion of the ribbon, and after the formed ribbon is advanced to the tying station, twisting the ends of the ribbon upon itself to thereby tie the article in the tying station.

26. A method for tying objects of varying diameter with a twist-tie ribbon including the steps of:

providing a twist-tie ribbon tying machine having an adjustable opening to receive an article to be tied and having means for adjusting the length of ribbon metered out for tying objects of variable diameters and for centering the article to be tied relative to the location of the tying station in accordance with the size of the article to be tied;

adjusting the machine for metering out a preselected length of ribbon;

adjusting the opening of the machine to center an article to be tied positioned within the opening in accordance with the diameter of the article relative to the location of the tying staion;

positioning and centering an article to be tied at the machine tying station;

metering out a preselected length of ribbon; and twist-tying the article positioned at the tying station with said length of twist-tie ribbon.

* * * * *